US008919418B2

(12) United States Patent
Carvallo

(10) Patent No.: US 8,919,418 B2
(45) Date of Patent: Dec. 30, 2014

(54) CURTAIN SYSTEM

(71) Applicant: Maria Paulina Carvallo, Chicago, IL (US)

(72) Inventor: Maria Paulina Carvallo, Chicago, IL (US)

( * ) Notice: Subject to any disclaimer, the term of this patent is extended or adjusted under 35 U.S.C. 154(b) by 0 days.

(21) Appl. No.: 13/688,833

(22) Filed: Nov. 29, 2012

(65) Prior Publication Data

US 2013/0139976 A1 Jun. 6, 2013

Related U.S. Application Data

(60) Provisional application No. 61/565,710, filed on Dec. 1, 2011.

(51) Int. Cl.
*A47G 5/02* (2006.01)

(52) U.S. Cl.
USPC ..... 160/241; 160/237; 160/180; 160/352

(58) Field of Classification Search
USPC ..... 160/241, 352, 180, 237, 328; 40/482
See application file for complete search history.

(56) References Cited

U.S. PATENT DOCUMENTS 3,065,785 A * 11/1962 Russell ..... 160/81
6,161,607 A * 12/2000 de Kimpe et al. ..... 160/238
7,163,044 B2 * 1/2007 Kirby ..... 160/262
2009/0089927 A1 4/2009 Li et al.
2012/0193041 A1 * 8/2012 Sun ..... 160/241
2013/0139976 A1 * 6/2013 Carvallo ..... 160/90

FOREIGN PATENT DOCUMENTS

JP 05-177282 A 7/1993
JP 2007-239290 A 9/2007
KR 10-0430821 B1 5/2004
WO WO-2011-012095 A2 2/2011

OTHER PUBLICATIONS

International Search Report and Written Opinion for PCT/US2012/067209 dated Feb. 27, 2013.
International Preliminary Report on Patentability for PCT/US2012/067209 dated Jun. 3, 2014.

* cited by examiner

*Primary Examiner* — Blair M. Johnson
(74) *Attorney, Agent, or Firm* — Marshall, Gerstein & Borun LLP

(57) ABSTRACT

A curtain assembly includes a curtain, or panel of flexible material, such as fabric, forming a generally smooth surface extending between a first anchor assembly and a second anchor assembly. Slits through the fabric are sized and arranged to be stretched opened to form respective openings in response to relatively small amounts of stretching of the panel between the two anchor assemblies with a tension force. The openings may be re-closed by allowing the panel to return to a relaxed state. The opening and closing action can be repeated according to new methods to controllably vary the amount of light that the curtain assembly allows through the panel. The curtain assembly may be used as part of various larger assemblies and in various environments.

25 Claims, 13 Drawing Sheets

CURTAIN SYSTEM

FIELD OF THE DISCLOSURE

The present disclosure is directed to systems, materials, and methods for controlling the transmission of light with a barrier, such as with a curtain system for use in buildings.

BACKGROUND

It is often desirable to provide a barrier that blocks or filters sunlight or otherwise screens, wind, rain, and/or other environmental phenomena from entering or exiting a selected space, such as a room or building. There are, of course, many different types of barriers that have been used over the centuries to accomplish this goal, ranging from solid opaque walls and roofs made from, for example, stone, wood, brick, stucco, concrete, or the like, to shutters or louvers, to transparent or translucent glass, to wax paper, and so on.

One exemplary barrier is a building façade. Building facades mediate between interior and exterior thermal conditions, providing passage of air and sunlight when requested while blocking their passage when it is undesirable. Over the past few decades, buildings with glazed building facades, i.e., facades substantially composed of glass window and wall systems, have become popular as they provide transparency. While these glazed building facades are beneficial in many ways, they also have environmental disadvantages in comparison with traditional opaque building facades, such as increased heat gain in summer, light pollution (also known as spill light), glare, and increased heat loss in winter.

The present inventor has been inspired from a focus on designing energy efficient building façades and an attempt to achieve optimum daylight levels and energy conservation by providing buildings with optimum openings. This is coupled with a basic understanding that openings through the building façade are an important component in building design and play a key role in saving energy and utilizing daylight. Further, effective use of daylight inside the building can be an important way to achieve energy cost savings. Therefore, strategies for optimizing the energy efficient use of daylight in architectural systems should be considered when designing openings in the building facade in order to meet daylight requirements and increase energy conservation.

Although currently known curtain wall glazing systems can balance the size and number of openings through the building facade to achieve energy conservation and optimum daylight levels, these systems allow tremendous amounts of energy to enter and exit through windows. Therefore, one goal of the present inventor is to provide a new barrier for openings that can be controllably adjusted between allowing a minimum transfer of light to allowing a maximum transfer of light with a minimum of movement of the barrier, thus saving operating energy costs and providing a more energy-efficient building facade. Another goal is to provide such adjustable barriers in openings with a limited amount of space or where lighting can be controlled during the course of the day. Of course, these and/or other goals and ends may be achieved with the systems disclosed herein in different forms and applications.

In searching for new solutions to these problems, the present inventor looked, surprisingly, to an ancient device used to control the transmission of light, such as by blocking or obscuring light: the curtain. In general terms, a curtain is normally considered to be a panel of flexible sheet material, such as cloth, plastic, or netting, that hangs downwardly from an upper support. In some instances, the curtain hangs freely under the force of gravity from the upper support, for example by having the upper support connected to a top edge of the panel with no other retention devices attached to the flexible sheet material. In other instances, the curtain is maintained in a taught condition by one or more additional retention mechanisms attached to other areas, such as a bottom edge and/or side edges of the panel.

A characteristic feature common to curtains and curtain systems until now has been that, in order to open or close the curtain to change the amount of light or air allowed therethrough, the panel must be moved in a manner that substantially changes the overall outline shape of the panel or change the entire position of the panel. For example, one side edge of the panel may be drawn toward an opposite side edge, or the bottom edge may be drawn up toward the top edge. Of course, the entire panel may be moved, such as to the side or by complete removal.

Curtains are used to block or obscure light in many different environments and applications. Some common environments in which curtain systems are used include windows or doorways, as room dividers, as exterior building walls, to divide one outdoor space from an adjacent outdoor space, in underwater environments, in space, in machines, in vehicles, and so on. However, until now, developments in the design of curtains has been generally limited to aesthetic choices and systems for hanging and moving the entire panel between open and closed positions. The fundamental design of the curtain panel has remained relatively unchanged from a basic panel made of cloth or other flexible material. Although these known barriers are often effective, the inventor of the curtain systems disclosed herein has attempted to provide a curtain system with which one can change the light and/or air transmission properties of the barrier in a fundamentally different way.

SUMMARY

According to some exemplary aspects, a curtain includes a panel of flexible fabric having a first axis in which the panel is arranged to be loaded under varying tension loads to shift between a closed state when relaxed and an open state when under tension. The panel has a plurality of spaced apart slits through the panel arranged in an array, wherein each slit has a component transverse to the first axis. The array includes at least a first plurality of the slits forming a first row and a second plurality of the slits forming a second row, wherein each of the first and second rows extends a transverse direction to the first axis. The slits of the second row are spaced apart from the slits of the first row along the first axis, and each of the first slits of the first row is laterally offset from and overlapping with the corresponding ones of the second slits of the second row in the transverse direction.

According to other exemplary aspects, a curtain includes a panel of flexible fabric having a first axis in which the panel is arranged to be loaded under varying tension loads to shift between a closed state when relaxed and an open state when under tension. A plurality of spaced apart slits extend through the panel, each slit having a first portion aligned in a first direction and a second portion aligned in a second direction angularly offset from the first direction. The slits are arranged in an array forming a row extending a transverse direction to the first axis.

According further exemplary aspects, a curtain assembly includes a panel of flexible fabric, a first anchor assembly supporting a first end of the panel, and a second anchor assembly supporting a second end of the panel, the first and second ends being opposite each other along a first axis. The panel has a plurality of spaced apart slits through the panel arranged in an array, each slit having a component transverse to the first axis. The array includes at least a first plurality of the slits forming a first row, and at least a second plurality of the slits forming a second row, wherein each of the first and second rows extends a transverse direction to the first axis. Each of the first slits of the first row is laterally offset from and overlapping with the corresponding ones of the second slits of the second row in the transverse direction. An actuator is associated with the first anchor assembly and arranged to move the first anchor relative to the second anchor in a manner sufficient to stretch and relax the panel along the first axis.

According to yet other exemplary aspects, a glazing assembly includes at least one pane of glass and a curtain assembly of the present disclosure disposed adjacent and substantially parallel to the pane. Optionally, the glazing assembly may include a second pane of glass. The curtain assembly may be disposed between the first and second panes. A frame may connect the first and second panes. The frame may extend around the outer peripheral edges of one or both of the first and second panes. The glazing assembly may form a portion of a door and/or a window.

According to still further exemplary aspects, a method of controlling transmission of light across a barrier with a curtain assembly of the present disclosure includes the steps of causing the slits to deform into larger openings by actuating the actuator to stretch the panel along the first axis, and allowing the openings to relax back to the slits by reversing the actuator to relax the panel along the first axis.

Any one or more of these exemplary aspects and optional arrangements may optionally further include any one or more of the following preferred forms.

In some preferred forms, the array may be a regular array, wherein each slit in each row is spaced from each adjacent slit in the respective row a regular repeating distance. The slits of the second row may be spaced apart from the slits of the first row along the first axis.

In some preferred forms, the first portion and the second portion of one or more of the slits may form a curve. One or more of the slits may have an oval shape. The first portion and the second portion may form an angle. One or more of the slits may have a polygonal shape. One or more of the slits may have the shape of a rhomboid.

In some preferred forms, each slit has a width along a second axis orthogonal to the first axis, wherein the overlap is equal to approximately one quarter the width.

In some preferred forms, the slits of the second row are spaced apart from the slits of the first row along the first axis. Each slit may has a height along the first axis. Each of the slits may be spaced from adjacent slits in the respective first or second row not more than one third the width. The first row may be spaced from the second row not more than one half the height.

In some preferred forms, the array comprises alternating first and second rows of the slits repeated along the first axis. The array may extend substantially across the entire area of the panel between the first anchor assembly to the second anchor assembly.

In some preferred forms, each slit has the same shape. The shape may include a component along the first axis and a component along the second axis.

In some preferred forms, the shape of one or more of the slits is a teardrop.

In some preferred forms, the slits are regularly spaced on center in each of the first and second rows a transverse period distance. The first slits may be offset from the second slits approximately one half the transverse period distance.

In some preferred forms, the first anchor assembly includes a roller. The actuator may cause the roller to wind and unwind to stretch and relax the panel. The actuator may include a motor arranged to rotate the roller. The actuator may include a chord, wire, chain, rope, belt, or lever arranged to rotate the roller.

In some preferred forms, the curtain assembly includes a second actuator associated with the second anchor assembly. The second anchor assembly may include a roller. The second actuator may be adapted to control rotation of the second anchor assembly in a manner to allow the panel to be stretched and relaxed.

In some preferred forms, the actuator is adapted to move the first anchor assembly in translation toward and away from the second anchor assembly.

In some preferred forms, the second anchor assembly is adapted to be maintained stationary while the actuator moves the first anchor assembly.

In some preferred forms, the flexible fabric may be formed of a woven fabric. The fabric may include at least one of a woven cloth, a non-woven cloth, natural fibers, and manmade fibers.

In some preferred forms, the fabric is sealed along each slit. The fabric may be sealingly heat welded along each slit.

In some preferred forms, the panel is planar. In some preferred forms, the panel is curved. Optionally, the panel may have both planar portions and curved portions.

In some preferred forms, the step of opening includes the actuator causing the roller to wind in a first direction. The step of closing may include allowing the roller to unwind in a second direction opposite the first direction.

In some preferred forms, the step of opening includes moving the first anchor assembly from a first position in translation away from the second anchor assembly to a second position. The step of closing may include moving the first anchor assembly from the second position back toward the first position.

Other aspects and advantages of the apparatuses and methods described herein will become apparent upon inspection of the detailed description and the drawings.

DETAILED DESCRIPTION

Figure 2:
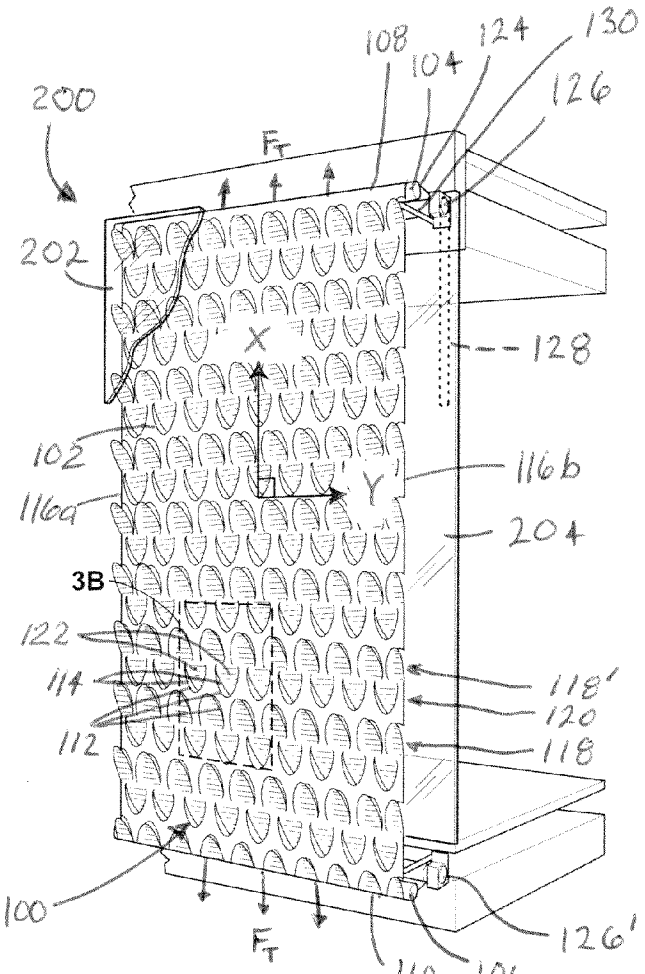
FIG. 2 shows the glazing assembly of FIG. 1 with a curtain assembly in an open state.

Turning now to the drawings, FIGS. 1-3B show a curtain assembly 100 according to a preferred aspect of the design. The curtain assembly 100 includes a curtain, or panel 102 of flexible material, preferably fabric, forming a smooth surface extending between a first anchor assembly 104 and a second anchor assembly 106. The panel 102 has a plurality of slits 112 through the fabric, preferably arranged in a regular array, that can be stretched opened to form a respective plurality of openings 114 in response to relatively small amounts of stretching of the panel between the two anchor assemblies 104, 106 with a tension force $F_T$. Further, the openings 114 may be re-closed by removing the tension force $F_T$ and allowing the panel 102 to return to a relaxed state. This opening and closing action can be repeated indefinitely and controllably to vary at least the amount of light that the curtain assembly 100 allows through the panel 102.

The first anchor assembly 104 supports a first end of the panel 102, such as the top end 108, and the second anchor assembly 106 supports a second end of the panel, such as the bottom end 110. It is noted that all directional descriptors, such as top, bottom, side, up, down, etc., are used for convenience in reference to the drawings, and are not otherwise limiting to the structure and functions of the apparatus and methods described. The top and bottom ends 108, 110 are disposed opposite each other along a first axis, longitudinal axis X, which is defined by an axis of stretching of the panel 102 to open and close the curtain assembly as described herein below. The fabric forming the panel may functionally extend beyond the top and bottom ends 108, 110, such as by wrapping around the first and second anchor assemblies or otherwise; however, for purposes of the description of this embodiment, the top and bottom ends 108, 110 are operationally equivalent with the location of the anchor assemblies 104, 106 supporting the panel 102 of fabric. The first anchor assembly 104 supports the top end 108 of the panel 102 and the second anchor assembly 106 supports the bottom end 110 of the panel. The anchor assemblies 104 and 106 maintain the panel 102 in a substantially smooth shape without substantial folds between the top and bottom ends, such as a planar or possibly arcuate form, and in a relaxed position without being under substantial additional tension beyond what is needed to maintain the panel in the smooth form.

The panel 102 is preferably made of a fabric formed of a large number of strands or fibers interconnected in any convenient manner sufficient to allow the fibers to stretch and/or distort in relation to each other under tensile loads as will become apparent hereafter. The fabric can be a woven cloth or a non-woven cloth, and can be made of natural fibers or manmade fibers, such as polyester fibers. In a preferred embodiment, the fabric is formed of polyethylene terephthalate (PET) fibers. If the fibers of the fabric are woven, the fibers may be woven in any desired pattern. If the fabric is made of non-woven fibers, the fibers may be joined by any convenient method, such as by blowing extruded plastic fibers or by matting, condensing, and pressing natural fibers such as wool to form a felt. The panel 102 may be made of other flexible sheet materials having similar stretching, draping, and flexing flexible flexibility characteristics as basic woven cloth, and therefore the term fabric as used herein is intended to encompass any such type of material.

A plurality of slits 112 are defined through the panel 102 and arranged so as to deform into larger openings 114 when the panel is placed under tension along the longitudinal axis X, such as by stretching, and to allow the openings 114 to reclose when the tension is removed from the panel. Each slit 112 is spaced apart from the adjacent slits, and preferably the slits are arranged across substantially the entire area of the panel between the top end and the bottom end in an array forming a plurality of rows. Further the array of slits also preferably extends completely between opposite side edges 116*a*, 116*b* of the panel 102, wherein each side edge extends substantially from the top end 108 to the bottom end 110. The array may be a regular array, wherein the slits are in a regularly repeating pattern of sizes and spaces across the area of the panel 102. Alternatively, the array may be an irregular array, wherein the slits 112 can have different sizes and be spaced apart different distances at different areas of the panel. For example and without limitation, an irregular array may have large slits spaced at a larger distance at one area of the panel 102 and smaller slits spaced closer together at another area of the panel. The side edges 116*a*, 116*b* may be in the form of a straight line, may be arcuate, may be polygonal, or take other shapes. In a preferred arrangement, the slits are arranged in rows aligned along a transverse axis Y, and the rows are spaced apart along the longitudinal axis X. In one preferred arrangement, the array includes a first row 118 adjacent a second row 120, and the first and second rows repeat alternatingly along the longitudinal axis X from the bottom end 110 to the top end 108.

The slits 112 may take many different shapes ranging from a straight line to geometric shapes, such as circles, squares, rectangles, and other polygonal shapes, to undefined undulating arcuate and/or segmented shapes. In any instance, however, each slit must have at least some component that is transverse to the longitudinal axis X, for example, in the shape of a straight or curved line that is angularly offset from the longitudinal axis X an angle greater than 0 and up to and including orthogonal at 90 degrees from the longitudinal axis X. In a preferred embodiment, each slit 112 has substantially the same shape and includes the first component transverse to the longitudinal axis X and a second component parallel with the longitudinal axis X. In this form each slit 112 has a width W in the transverse axis Y and a height H along the longitudinal axis X. For purposes of this description, the transverse axis Y is orthogonal to the longitudinal axis X. In a preferred arrangement shown in FIGS. 1-3B, each slit 112 has a teardrop shape formed by a first arcuate section 112*a* and a second arcuate section 112*b*, wherein the first arcuate and second arcuate sections 112*a*, 112*b* connect at one end of the teardrop and are spaced apart at an opposite end of the teardrop shape as most clearly seen in FIG. 3A. In other embodiments, however, different slits in the panel may have varying shapes, and/or the slits are not arranged in a regular array.

Each slit 112 extends completely through the flexible fabric of the panel 102 and may be formed in any convenient manner, such as by cutting, slicing, stamping, etc. Preferably the slits 112 are formed in a manner that will seal the edges of the fabric along the length of the slit so as to prevent fraying of the fibers of the fabric along the edges of the slit. A preferred method of forming a slit includes using a heated cutting tool that will weld or burn the edges of the fabric along the slit. One such tool includes a laser cutter (not shown), which can burn and/or melt the edges of the fabric along the edges of the slit as the slit is being formed.

Figure 3A:
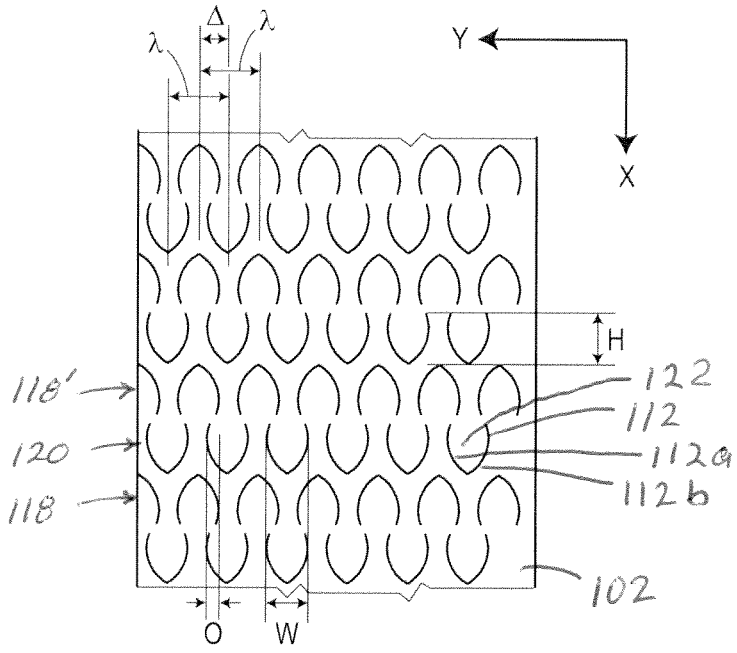
FIGS. 3A and 3B show detailed portions of a panel of fabric of the curtain assembly as identified in FIGS. 1 and 2 in the closed state and in the open state.
Figure 3B:
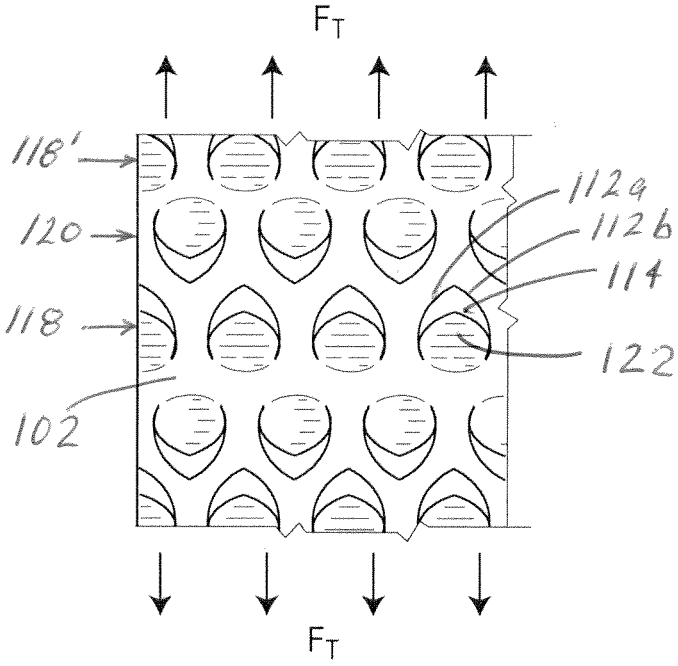

As best seen in the detail of FIGS. 3A and 3B, in one preferred array arrangement, the first row 118 is formed of a first plurality of the slits 112 and the second row 120 is formed of a second plurality of the slits 112. Each of the first and second rows 118, 120 extends in a transverse direction from the longitudinal axis X, preferably aligned along the transverse axis Y. However, as shown in later examples, the rows 118, 120 do not have to be orthogonal to the longitudinal axis X but may be aligned at other angles transverse to the longitudinal axis X. The slits of the first row 118 are spaced apart from the slits of the second row 120 along the longitudinal axis X, preferably a distance not greater than one half the height H, and in some instances the first row is spaced from the second row any distance between one half the height H and 0. In addition, each of the first slits in the first row 118 is laterally offset along the transverse axis Y from a corresponding slit in the second row 120, a transverse shift distance Δ, preferably a distance between 0 and the width W. Further each of the first slits 112 of the first row 118 is also preferably laterally overlapping with the corresponding second slit 112 of the second row 120 an overlap distance O along the transverse axis Y. The overlap distance O preferably is between 0 and one half the width W, and more preferably approximately one quarter the width W. Each slit 112 is spaced from adjacent slits in the respective row a distance preferably not more than one third the width W. However other spacing may be used and perform acceptably within the purview of the present disclosure. In FIGS. 3A and 3B, for example, the slits 112 in the first row 118 are regularly spaced along the row a transverse period distance λ. Preferably the period distance λ is constant across each row and extends from a location on one slit to the same location on the adjacent slit, such as from the center of the shape of one slit to the center of the shape of the adjacent slit. However, other period distances may be defined across a plurality of slits that are grouped in repeating arrays along the row. The first slits of the first row 118 are offset from the second slits of the second row 120 a transverse shift distance Δ along the transverse axis Y equal to approximately one half the transverse period distance λ. Of course, other distances may be used and provide the effects of the present disclosure.

Figure 1:
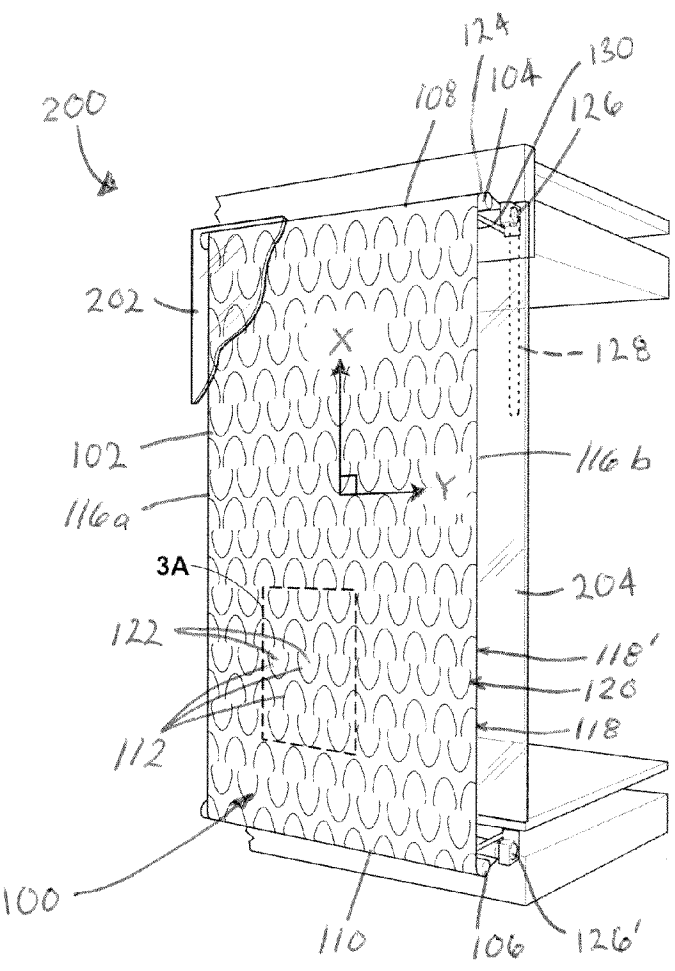
FIG. 1 shows a glazing assembly including a curtain assembly according to a first embodiment wherein the curtain assembly is in a closed state.

In the example shown in FIGS. 1-3B, each slit 112 has a teardrop shape as previously described with a height H of nine sixteenth inches and width W of three eighths inches. The first row 118 of first slits is not spaced from the second row 120 of second slits, but rather the distance between the first and second rows is 0. However, the second row 120 is spaced from the next adjacent first row 118' along the longitudinal axis X a distance of one eighth inch. Further, each first slit of the first row 118 transversely overlaps the corresponding slit of the second row an overlap distance O of approximately three thirty second inches and the transverse offset distance Δ between the slits of the first row and the slits of the second row is one half of the transverse period distance λ. In this arrangement, each slit 112 defines a flap 122 that covers the opening 114. When the panel 102 is in a relaxed state as shown in FIGS. 1 and 3A, the flaps 122 are in a relaxed position that is substantially coplanar with the surrounding surface of the panel 102 and the panel is closed. When the panel is stretched or placed under tension $F_T$, such as between the first and second anchor assemblies 104, 106, the fabric of the panel 102 distorts around the slits 112 and causes the flaps 122 to distort out of the surrounding plane of the panel and thereby open the openings 114 through the fabric and the panel is open, as shown in FIGS. 2 and 3B. Thus, when the panel 102 is in a relaxed state, the flaps 122 are closed and substantially block transmission of light through the panel; however when the panel is under tension $F_T$, the flaps 122 distort outwardly and allow light to pass through the openings 114. A significant advantage of this action is that the panel 102 can be controllably adjusted between a closed state, in which the panel is relaxed and the flaps are coplanar with the overall shape of the panel, and an open state, in which the flaps are bent out of plane from the overall shape of the panel, with a relatively small motion or travel distance, which can conserve energy as compared to previously known curtain systems.

An actuator 126 is associated with the panel 102 in any suitable manner to open and close the panel curtain assembly 102. In the example of FIGS. 1 and 2, the actuator 126 is associated with the first anchor assembly 104 and arranged to drive the first anchor assembly relative to the second anchor assembly 106 in a manner sufficient to stretch and relax the panel 102 and thereby shift the panel from the closed state to the open state and back in a controllable manner, as described herein before. In one preferred arrangement, each of the upper and lower anchor assemblies 104, 106 includes a bar extending completely across the panel 102 between the side edge 116*a* and the side edge 116*b* and a roller assembly 124 carried by the bar. The actuator 126 is arranged to rotate the roller assembly 124 back and forth about the bar to stretch or relax the fabric of the panel 102. The roller assembly 124 is secured with the panel 102 by any convenient mechanism, such as by friction and/or glue and/or other fasteners, such that the roller assembly stretches the panel when rotated in a first direction, and allows the panel to relax when rotated in an opposite direction. The actuator 126 includes a motor and sufficient control switching that are arranged to rotate the roller back and forth in a controlled manner in response to appropriate control signals sent by an operator or actuation controller such as a computer, switch, or any other actuation control mechanism.

The actuator 126 may include other mechanisms suitably arranged for moving, stretching, and/or relaxing the panel 102, between the open and closed states as described above. For example, the actuator 126 may comprise a manual actuation system, such as a pull cord 128 adapted to be manually pulled by an operator in a manner well-known in the curtain arts. The pull cord 128 may be formed of any suitable arrangement, such as a wire, chain, rope, belt, or any other flexible cord arrangement. In another option, the second anchor assembly 106 also may include a roller assembly carried by a bar and arranged to engage the panel and allow the panel to shift along the second anchor assembly. In such an assembly, a second actuator 126' may be associated with the second anchor assembly 106, to control rotation of the roller assembly in a coordinated fashion with the first actuator 126 and first anchor assembly 104. In a further option, the actuator 126 may include a mechanism for moving the first anchor assembly 104 in translation up and down along the longitudinal axis X, such as a lever and gearing assembly 130, a pulley system, and/or other mechanical linkage systems arranged to move the first anchor assembly 104 up and down in a controlled manner. In this arrangement, the second anchor assembly 106 is preferably, although not necessarily, maintained in a stationary position along the longitudinal axis X, so that movement of the first anchor assembly 104 is sufficient to stretch and/or relax the panel without requiring additional movement of the second anchor assembly. It is also understood that the actuator 126 may be associated with any portion of the panel 102 sufficient to cause stretching and relaxing of the panel along the longitudinal axis X.

In one contemplated use environment, as shown in FIGS. 1 and 2, the curtain assembly 100 is part of a larger glazing assembly 200 suitable for use in a building or in any other use where a glass and curtain assembly may be useful. In particular, the glazing assembly 200 includes at least a first pane of glass, such as an exterior pane of glass 202, and the curtain assembly 100. The curtain assembly 100 is disposed adjacent to the exterior pane of glass 202 and is substantially parallel to the pane 202. Thus for example, the pane of glass 202 is on an exterior side of a window, wall, or doorway opening, and the curtain assembly 100 is disposed on an interior side of the pane of glass, so as to be protected from the external elements, such as wind and rain. However, the curtain assembly 100 may be placed on an exterior side of the pane of glass 202. The glazing assembly 200 optionally also includes a second pane of glass on an interior side of the curtain assembly 100, such as an interior pane of glass 204. The interior pane of glass 204 is substantially parallel to and in an opposing relation with the exterior pane of glass 202, and the curtain assembly 100 is disposed therebetween. In this arrangement, the curtain assembly 100 is protected by the glass on each opposite side from environmental factors that may be detrimental to optimum functioning of the curtain system 100, such as contact by humans or animals or external environmental weather conditions. The exterior pane of glass 202 also may prevent or limit passage of ultraviolet energy, such as with a UV filter coating, to further protect the fabric of the panel 102 from deleterious effects of UV light.

Figure 4:
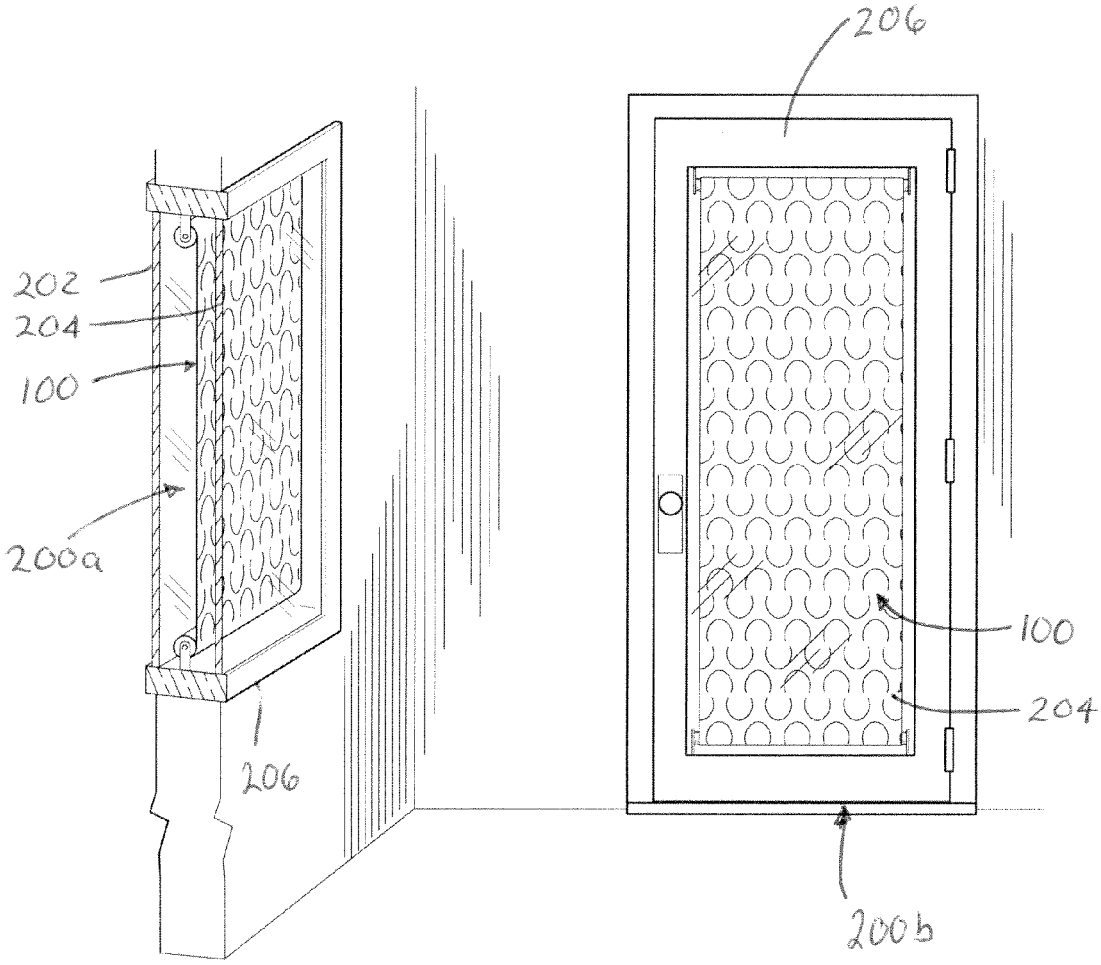
FIG. 4 shows the glazing assembly of the present disclosure in two different uses as a window and as a door.

The glazing assembly 200 optionally is held together with a peripheral frame 206 extending at least partly around the outer periphery of the panes of glass 202, 204 and the curtain assembly 100, generally in the plane of the panes and the panel 102, as best seen in FIG. 4. The frame 206 may be part of a larger building construction assembly including, for example, walls, beams, and columns, or the frame may be secured with the panes of glass 202, 204 and the curtain assembly 100, as part of a separate self contained unit. In the latter case, the pane may take the form of a pre-selected shape, such as a rectangle or oval, that fits closely around the outer peripheral edges of the panes 202, 204 and the panel 102, and secures the panes and the panel and the anchor assemblies 104, 106, and optionally any actuator system such as the actuator 126 in a single unit. Thus the glazing assembly 200 with the curtain assembly 100 may be used in a myriad of different applications within the scope of the present disclosure.

The curtain assembly 100, when installed, allows a user to control the transmission of light across a selected barrier defined by the panel 102 in new manners and methods. One exemplary method of using the curtain assembly 100 includes in a first step causing the slits 112 to deform the flaps 120 out of the pane of the panel 102 and thereby to enlarge or open the openings 114 by actuating the actuator 126 in a first direction to stretch the panel of fabric 102 in the first direction along the longitudinal axis X. In a second step, the curtain assembly 100 may be returned to the closed state by reversing the actuator 126 and allowing the panel 102 to relax in the opposite direction along the longitudinal axis X, thereby removing the tension $F_T$ from the panel 102 and allowing the flaps 120 to return in-plane with the panel 102 and close the openings 114. In the case where the anchor assembly 104 includes a roller assembly and the actuator 126 is arranged to rotate the roller back and forth to stretch and relax the panel 102, the step of opening is performed by engaging the actuator to cause the roller to wind in the first direction that will stretch the panel 102, and the step of closing includes engaging the actuator to allow the roller to unwind in an opposite direction sufficient to return the panel 102 to an un-stretched state. In an embodiment where the actuator 126 is adapted to move the first anchor assembly 104 in translation toward and away from the second anchor assembly 106, the step of opening the curtain assembly 100 includes moving the first anchor assembly from a first position in translation away from the second anchor assembly along the longitudinal axis X, and the step of closing the curtain assembly includes moving the first anchor assembly from the second position in translation back toward the first position in along the longitudinal axis X.

In FIG. 4, the glazing assembly 200 is shown in two different applications. In a first application the glazing assembly 200 is used as a window unit 200*a* disposed in a wall of a building. In a second application, the glazing assembly 200 is shown used as part of a door unit 200*b* in another wall of the building. In these examples, the window unit 200*a* and the door unit 200*b* are substantially the same as the glazing assembly 200 as previously described herein with minor modifications being made for use as either the window or a door as would be obvious to one of ordinary skill As can be seen from the drawings, the curtain assembly 100 also provides unique aesthetic properties by using the panels 102, including an array of the slits 112 and flaps 122 as described generally herein that is not available from previously known curtain systems. The choice of shape for the slits and the arrangement of array of slits provide decorative design aspect that can be varied according to the aesthetic choices and taste of a designer and/or consumer. As will become clear from descriptions below, the aesthetic properties of the panel 102 and the overall curtain assembly 100 can be almost infinitely varied depending upon the shape of the slit chosen, the various spacings and groupings of slits in a particular array, the shape of the panel 102, and other decorative choices.

Turning now to FIGS. 5A-21B, different shapes of slits and slit arrays are shown as exemplary alternative shapes and array designs. It is understood, however, that the inventor anticipates these as merely exemplary of the almost infinite different arrangement of slit shapes and arrays that would be possible for use according to the present disclosure. Each of the arrays of slits shown in FIGS. 5A-21B could be used in the panel 102 of the curtain assembly 100 and the various glazing assemblies of the present disclosure in any combination consistent with the overall disclosure. Dimensions are provided in units of inches.

Figure 5A:
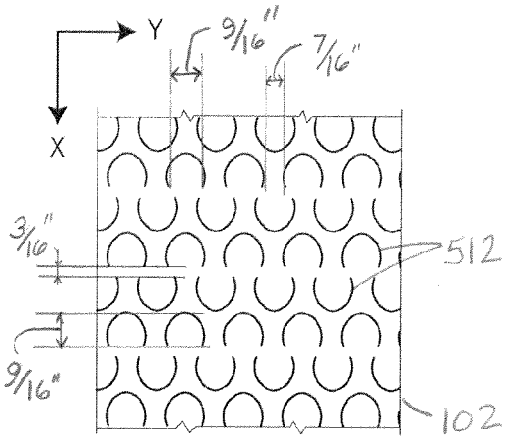
FIGS. 5A, 6A . . . 21A show detail views of curtain panels adapted for use in the curtain assembly having different exemplary arrays of slits and slits of different shapes with the panel of the curtain assembly in a closed state, and FIGS. 5B, 6B . . . 21B show the corresponding arrays of slits with the panels in an open state.
Figure 5B:
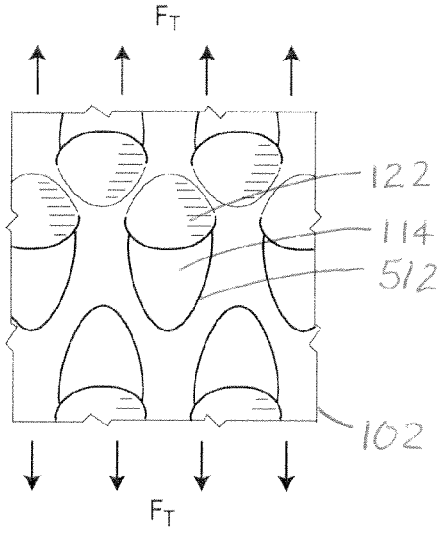

FIGS. 5A and 5B show an array of slits 512 similar to the array of FIGS. 3A and 3B and with different sizing and spacing of the width, height, and overlap as shown in the figures. Also, the shape of each slit 512 is slightly wider than the slits 112 in FIGS. 3A and 3B.

Figure 6A:
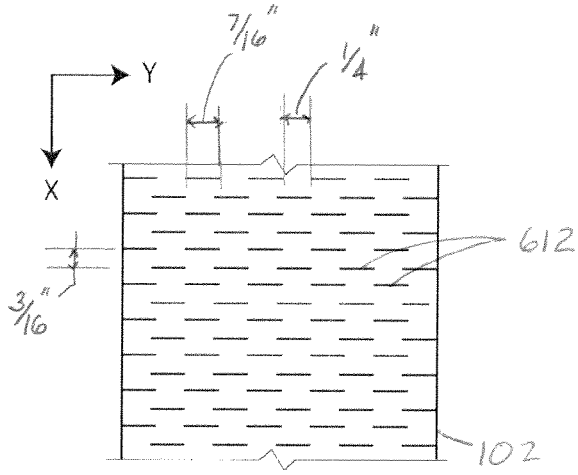
Figure 6B:
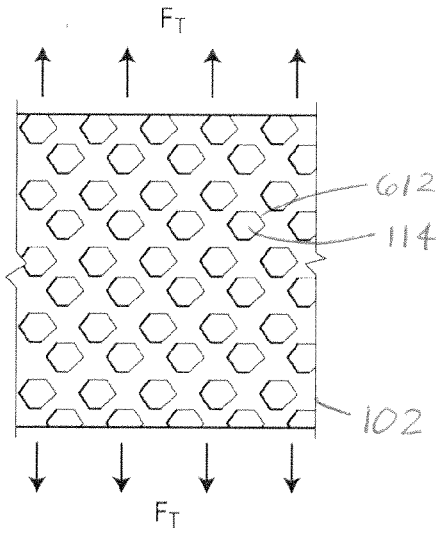
Figure 7A:
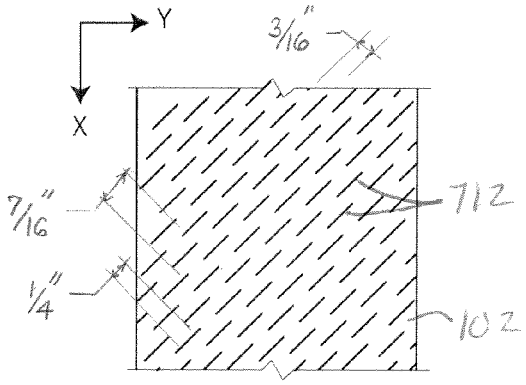
Figure 7B:
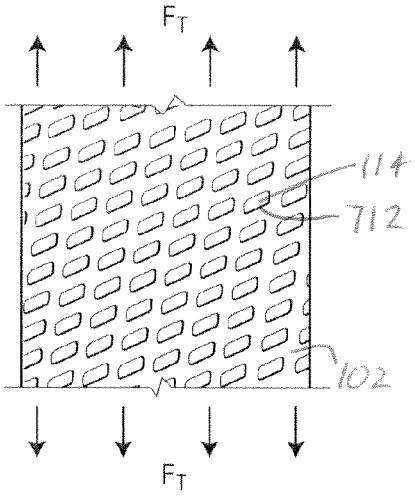

FIGS. 6A and 6B show an array of slits 612, in which each slit has the shape of a straight line oriented orthogonal to the longitudinal axis X of the panel 102. FIGS. 7A and 7B show an array of slits 712, in which each slit 712 is oriented at approximately 45 degrees to the longitudinal axis X and each slit has the shape of a straight line. It is noted that the array in FIGS. 7A and 7B is substantially similar to the array in FIGS. 6A and 6B, except for the angular orientation of the slits with respect to the longitudinal axis X of the direction of pull on the panel 102. Unlike the various slits shown in the remaining drawings, the slits 612, 712 shown in FIGS. 6A-7B do not form flaps 122 when in the open state.

Figure 8A:
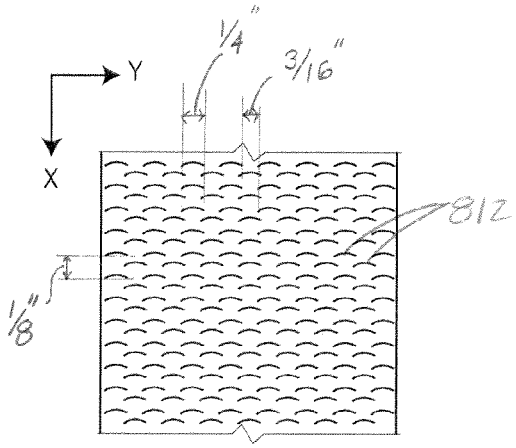
Figure 8B:
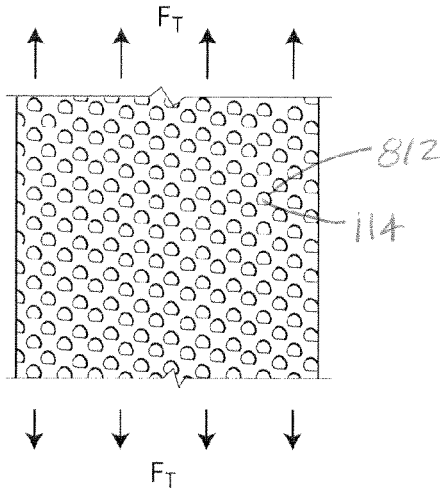

FIGS. 8A and 8B show another array arrangement of slits 812, wherein each slit is in the form of a single arcuate section having a radius substantially longer than the length of slit. The slits 812 also do not form an easily identifiable, if any, flap in the open position.

Figure 9A:
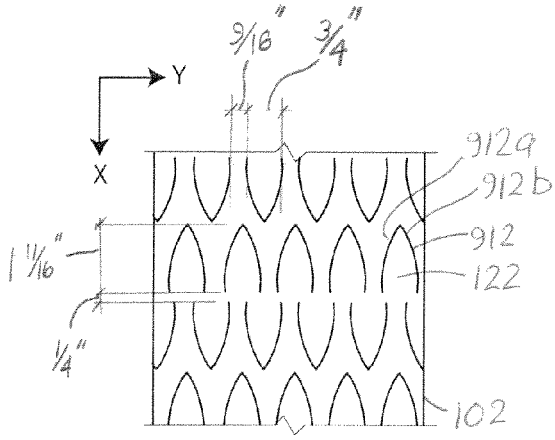
Figure 9B:
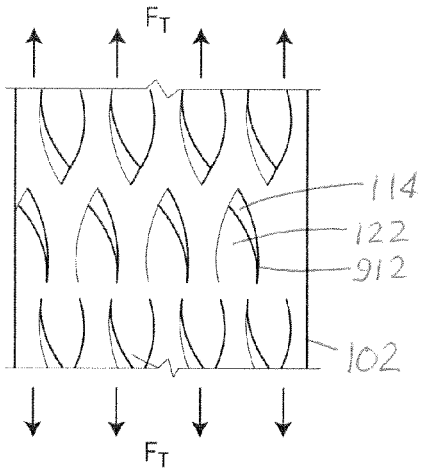

FIGS. 9A and 9B show an array of slits 912, wherein each slit generally has a flame shape including two arcuate sections 912*a*, 912*b* that converge at one end and are spaced apart at an opposite end.

Figure 10A:
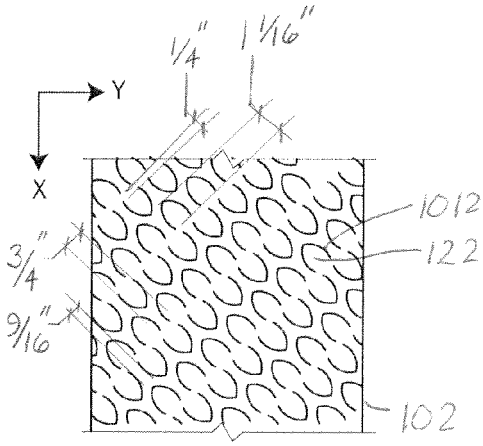
Figure 10B:
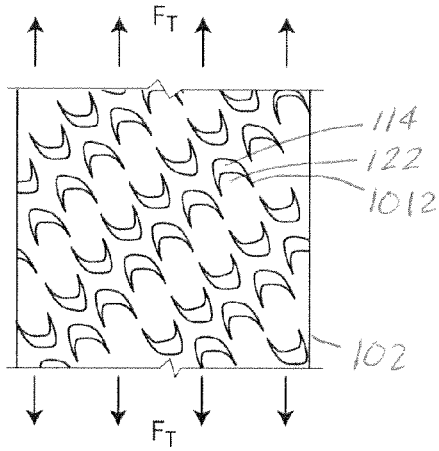
Figure 11A:
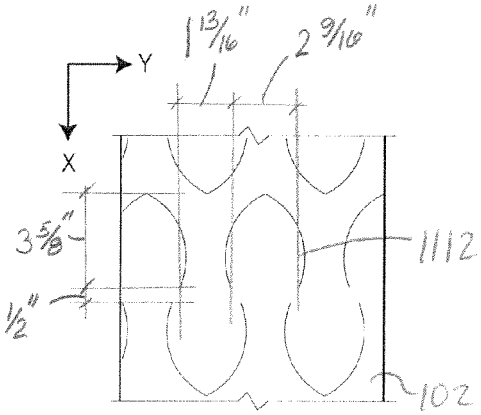
Figure 12A:
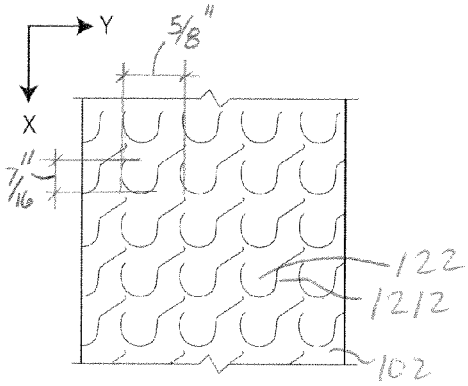
Figure 11B:
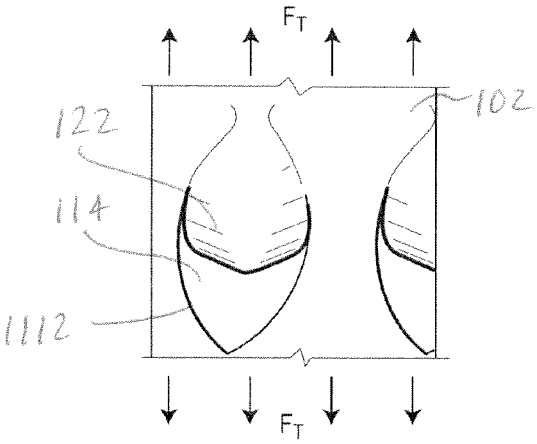
Figure 12B:
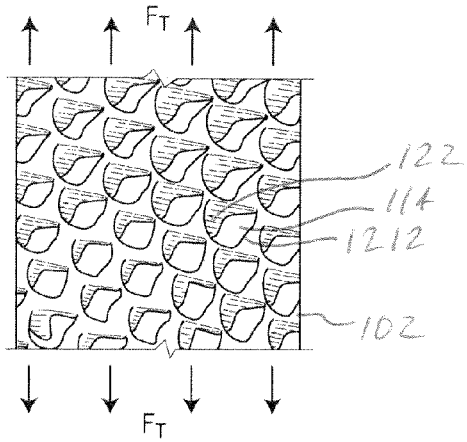

FIGS. 10A and 10B show an array of slits 1012 that is generally similar to the array shown in FIGS. 5A and 5B, except with slightly different spacings between the slits, and the rows of slits are oriented at approximately 45 degree angle with respect with the longitudinal axis X. FIGS. 11A and 11B show yet a further array of slits 1112 generally similar to the array shown in FIGS. 5A and 5B but having different spacings and sizing.

FIGS. 12A-15B show additional arrays of slits 1212, 1312, 1412, 1512, wherein the slits have various undefined undulating shapes and various sizes and spaces as indicated in the drawings.

FIGS. 16A-17B show two different array of slits 1612, 1712, wherein the shapes of the slits alternate as minor images of each along each row 118 along the transverse axis Y on opposite sides of a centerline of the row.

FIGS. 18A-21B show four additional array of slits 1812, 1912, 2012, 2112, having various geometric shapes and repeating array patterns as shown in the drawings.

Figure 22:
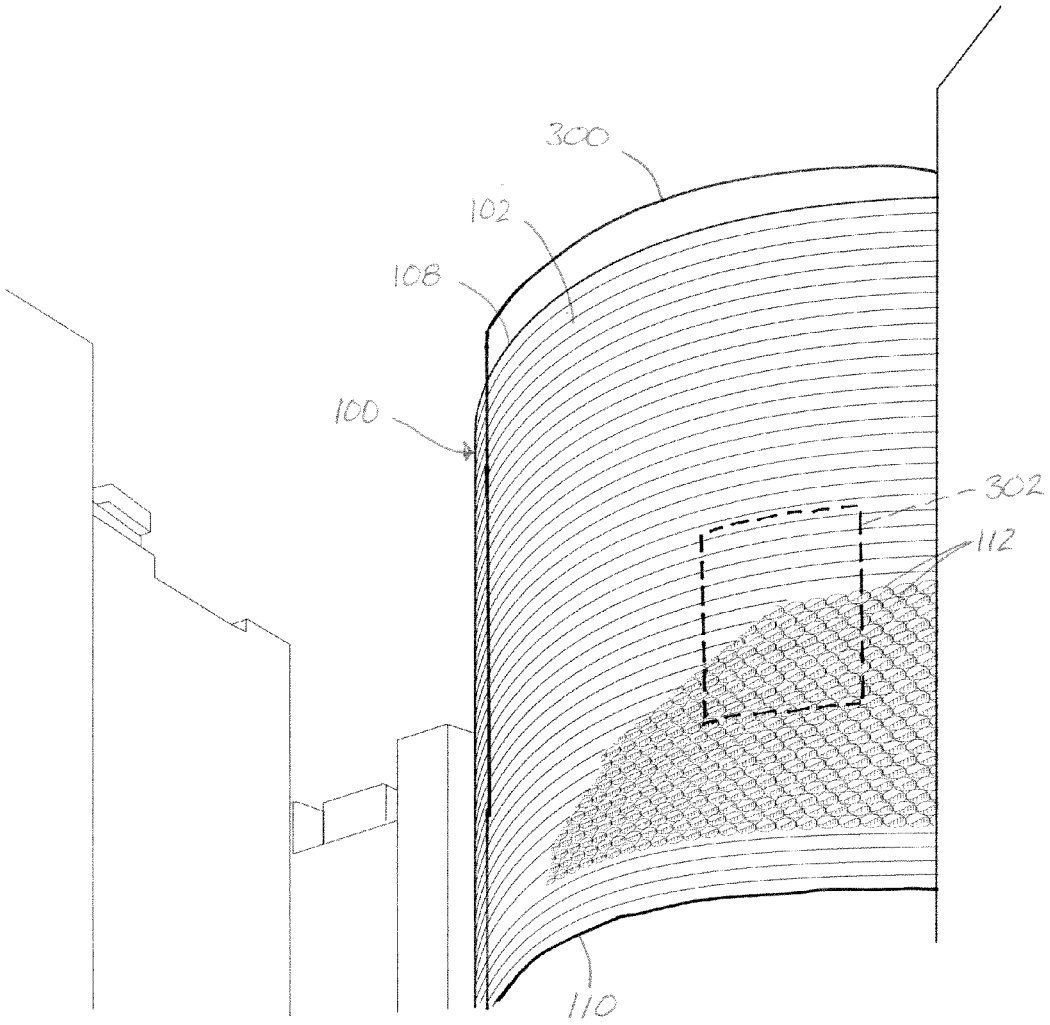
FIG. 22 shows the curtain system adapted for use as an exterior facade of a building.

FIG. 22 shows another contemplated use of the curtain assembly 100 as an exterior facade for a building 300, such as in front of one or more glazing panels 302. The curtain assembly 100 may include any of the detailed variations described and/or suggested previously herein. Of particular note is that the curtain assembly 100 is formed in a generally smooth substantially arcuate surface, rather than a generally smooth planar surface as shown in FIGS. 1 and 2. This exemplifies another benefit of the curtain assembly 100, which is that the panel 102 is not limited to a planar shape but may be formed and operated in an arcuate shape with appropriate adaptation and selection of the anchor assemblies 104 and 106 in arcuate form, such as with an arcuate rod and roller assembly. The exemplary use of the curtain assembly 100 shown in FIG. 22 also highlights the significant aesthetic benefits and uses of the curtain assembly that can be built upon for almost an infinite number of decorative design choices in addition to the functional features described herein.

Figure 13A:
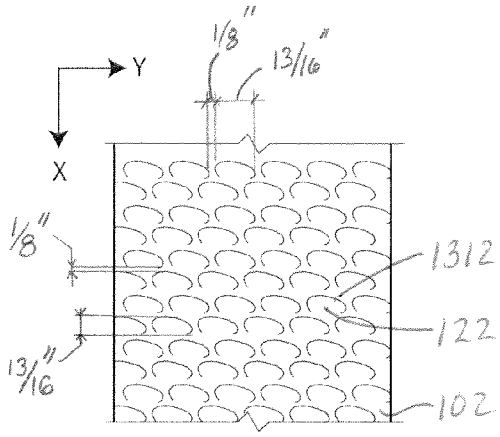
Figure 14A:
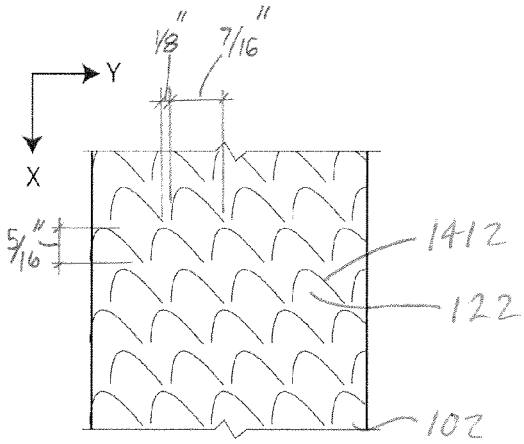
Figure 13B:
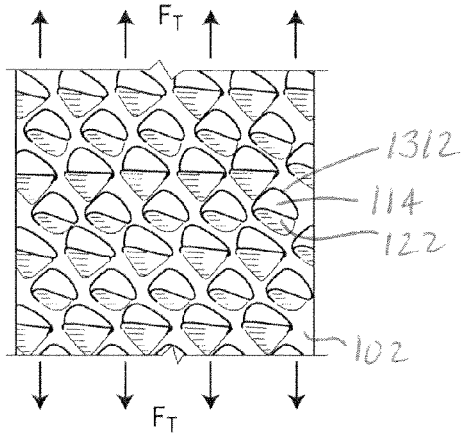
Figure 14B:
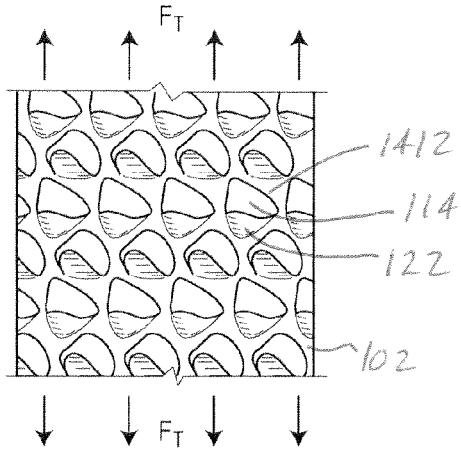
Figure 15A:
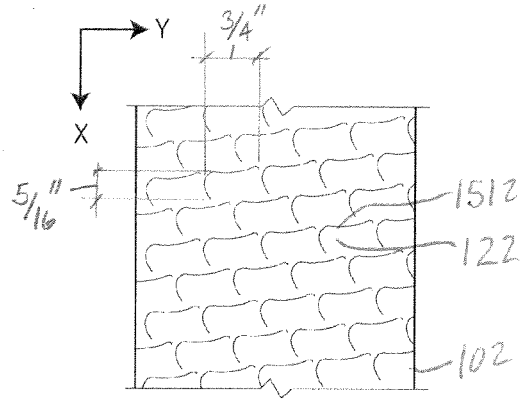
Figure 16A:
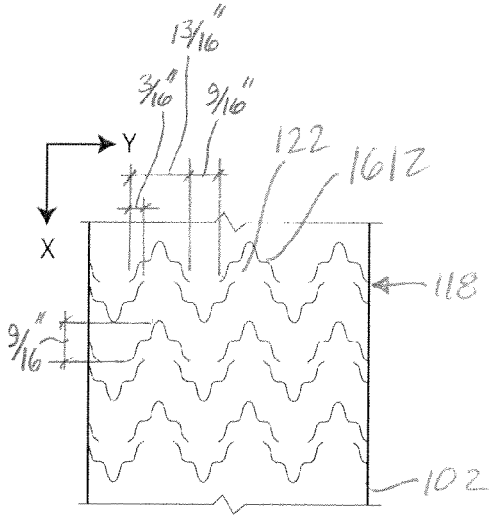
Figure 15B:
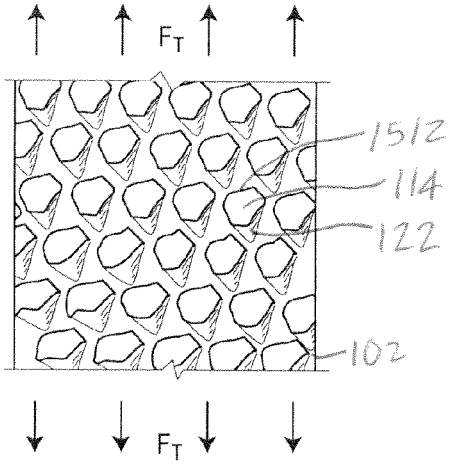
Figure 16B:
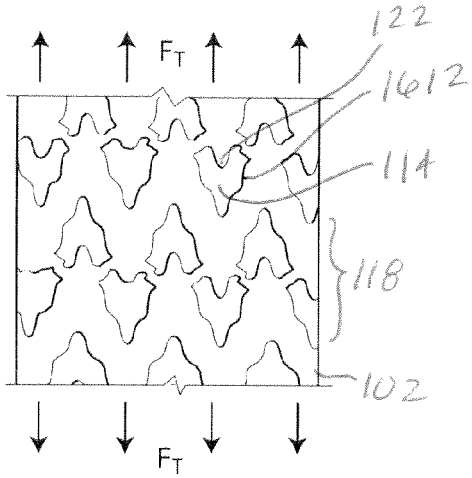
Figure 17A:
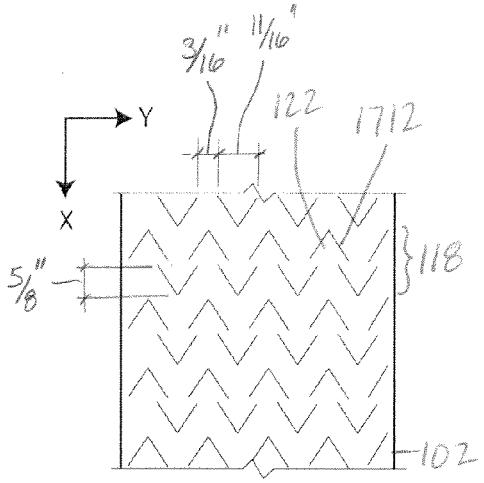
Figure 18A:
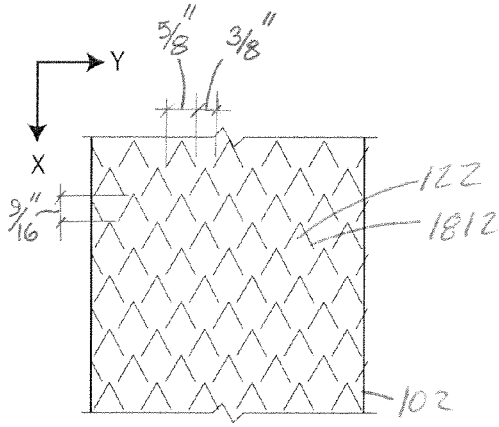
Figure 17B:
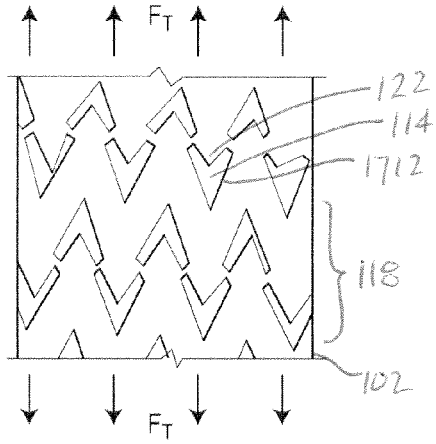
Figure 18B:
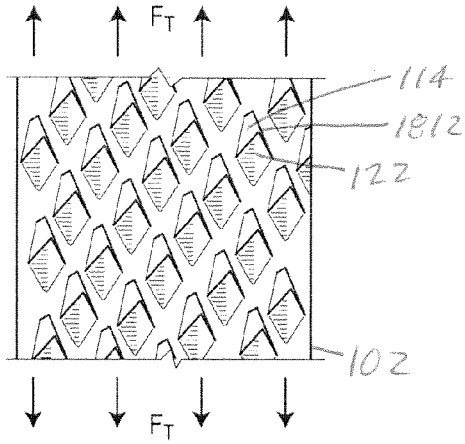
Figure 19A:
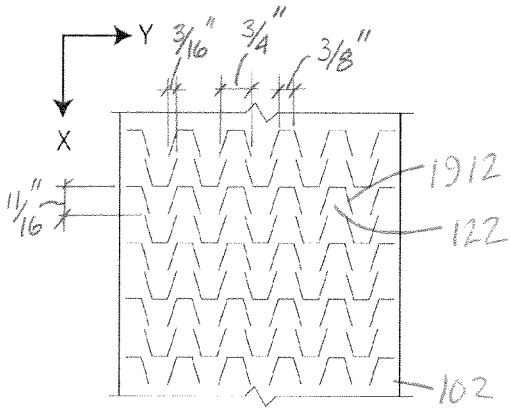
Figure 20A:
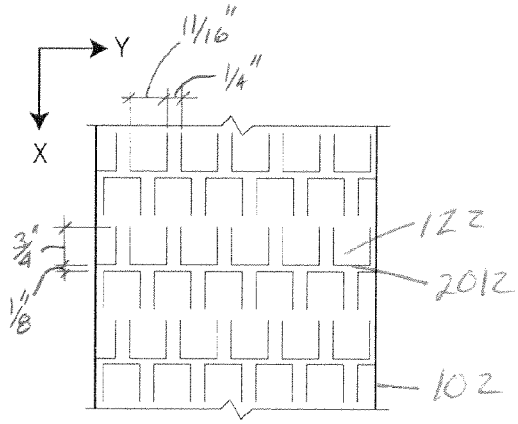
Figure 19B:
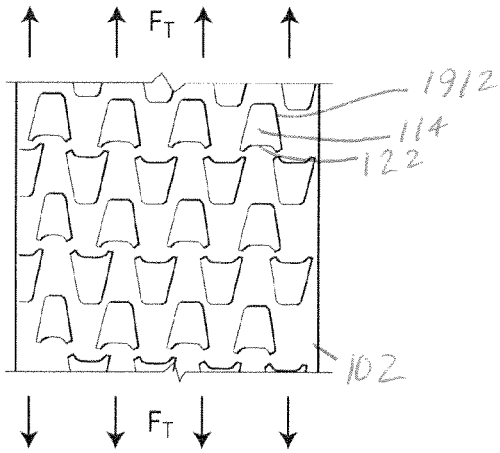
Figure 20B:
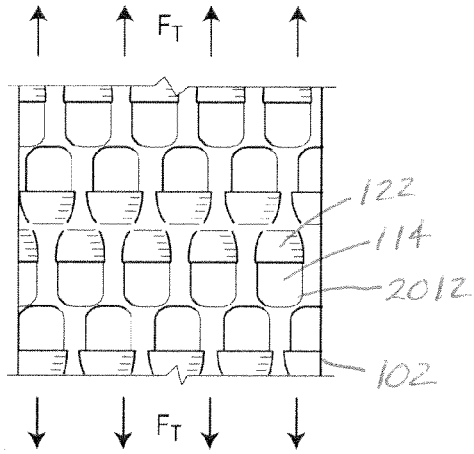
Figure 21A:
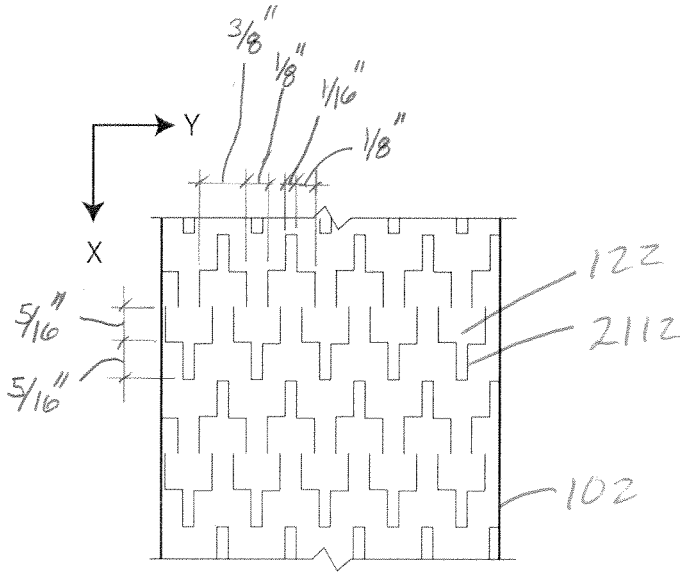
Figure 21B:
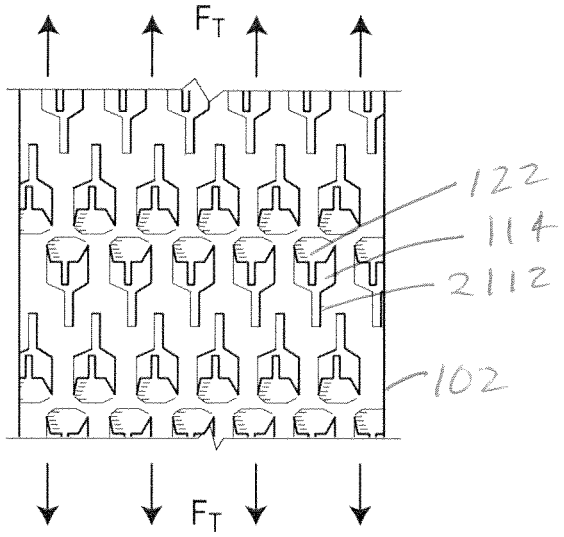

In another variation, the panel 102 need not have a minimum of two rows of the slits 112. Rather, the panel 102 can function to open and close as described with only a single row of spaced apart slits if each slit 112 has a first portion aligned in a first direction and a second portion aligned in a second direction angularly offset from the first direction. In this arrangement, the slits 112 can have any shape that is non-linear, such as polygonal, arcuate, and combinations of polygonal and arcuate. For example, the first portion and second portions of the slit 112 may form a curve or an angle. Some exemplary shapes, without limitation, that would be sufficient for function in this variation include an oval shape such as shown in FIGS. 13A and 13B, a rhomboid shape such as shown in FIGS. 19A and 19B, the teardrop shapes shown in FIGS. 3A, 3B, 5A, 5B, 9A, 9B, 10A, 10B, 11A and 11B, the triangular shapes shown in FIGS. 17A, 17B, 18A, 18B, and other non-linear shapes shown in the drawings and not shown in the drawings.

The various applications described herein are exemplary of just a few potential uses for curtain panels having opening patterns as described. The curtain panels can be applied at a variety of scales and for a variety of uses. Given this, alternate systems can be designed to comply with various solar shading, light transmission, air movement, and water direction design criteria. This could include, for example and without limitation: forming channels or bowls for collecting water; opening and closing small opening within a skin for ventilation; increasing volume between the stretch material textile and a second skin closely adjacent to move air or water through a skin system for insulation; heating; cooling; and, collecting and expelling water vapor and channeling air or water on a surface to bring it to different zones of use. Another application, just as a bird might ruffle its feathers to stay warm, the slits that form the textile openings could increase its sectional area to capture insulative fluids such as air. In this example, gradient thickness could be created or this could take place across large fields of skin, forming insulative zones where needed and when needed. Sometimes heat energy must be contained within a system, and sometimes it must be released. For example, the curtain systems having slits that form textile openings as disclosed herein can be created for a greenhouse, where plants would need varying amounts of ventilation and/or light and/or water. The textile openings could open up at the top of the greenhouse to allow the hot air out. Also, the walls of the greenhouse could open up to direct sunlight and rainfall into the greenhouse.

In addition to being a fundamentally different design for a curtain system than previously known heretofore, the curtain assembly 100 disclosed herein may provide environmental benefits in the building arts over currently known curtain, blind, and/or louver systems by using less and/or lighter material in the form of a light fabric rather than heavier wood, plastic, or metal louver panels or blinds. Further because a significantly smaller amount of movement is needed to actuate the panel 102 between the open and closed states of the flaps 122, the energy required to actuate movement of the curtain system 100 between the open and closed states may be significantly less than in current curtain blind and louver systems. The curtain systems according to the principles described herein also advantageously could allow the inhabitants in building to be more connected to the environment and less dependent upon mechanical systems. Additional benefits and uses are clearly anticipated by the inventor, and the disclosure is not limited to any of the particular uses and environments, nor is the design required to obtain any or every possible benefit or objective suggested herein.

What is claimed:

1. A curtain assembly comprising:

a panel of flexible fabric;

a first anchor assembly supporting a first end of the panel;

a second anchor assembly supporting a second end of the panel, the first and second ends being opposite each other along a first axis;

the panel comprising a plurality of spaced apart slits through the panel, each slit having a component transverse to the first axis, the slits arranged in an array, the array comprising a first plurality of the slits forming a first row, and a second plurality of slits forming a second row, each of the first and second rows extending a transverse direction to the first axis, and the slits of the first row being laterally offset from and overlapping with corresponding slits of the second row in the transverse direction, wherein one of the slits of the first row overlaps a corresponding one of the slits of the second row by an overlap distance greater than zero, wherein each slit also has a component along the first axis that causes the slit to define a flap that protrudes outside a plane of the panel when the panel is stretched; and an actuator associated with the first anchor assembly, the actuator arranged to move the first anchor relative to the second anchor in a manner sufficient to stretch and relax the panel along the first axis.

2. The curtain assembly of claim 1, wherein each slit has a width along a second axis orthogonal to the first axis, wherein the overlap distance is no more than one half the width.

3. The curtain assembly of claim 2, wherein the slits of the second row are spaced apart from the slits of the first row along the first axis, each slit further has a height along the first axis, each of the slits is spaced from adjacent slits in the respective first or second row not more than one third the width, and the first row is spaced from the second row not more than one half the height.

4. The curtain assembly of claim 3, wherein the array comprises alternating first and second rows of the slits repeated along the first axis, and wherein the array extends substantially across the entire area of the panel between the first anchor assembly to the second anchor assembly.

5. The curtain assembly of claim 4, wherein each slit has the same shape.

6. The curtain assembly of claim 5, wherein the shape is a teardrop.

7. The curtain assembly of claim 2, wherein the slits within each row are regularly spaced on center a transverse period distance, and wherein the slits of the first row are offset from the slits of the second row approximately one half the transverse period distance and no more than the width.

8. The curtain assembly of claim 1, wherein the first anchor assembly comprises a roller and the actuator causes the roller to wind and unwind to stretch and relax the panel.

9. The curtain assembly of claim 8, wherein the actuator comprises a motor arranged to rotate the roller.

10. The curtain assembly of claim 8, wherein the actuator comprises a chord, wire, chain, rope, belt, or lever arranged to rotate the roller.

11. The curtain assembly of claim 8, wherein the second anchor assembly comprises a roller.

12. The curtain assembly of claim 11, further comprising a second actuator associated with the second anchor assembly, the second actuator adapted to control rotation of the second anchor assembly in a manner to allow the panel to be stretched and relaxed.

13. The curtain assembly of claim 1, wherein the actuator is adapted to move the first anchor assembly in translation toward and away from the second anchor assembly.

14. The curtain assembly of claim 13, wherein the second anchor assembly is adapted to be maintained stationary while the actuator moves the first anchor assembly.

15. The curtain assembly of claim 1, wherein the fabric comprises at least one of a woven cloth, a non-woven cloth, natural fibers, and manmade fibers.

16. The curtain assembly of claim 1, wherein the fabric is sealed along each slit.

17. The curtain assembly of claim 16, wherein the fabric is sealingly heat welded along each slit.

18. The curtain assembly of claim 1, wherein the panel is planar.

19. The curtain assembly of claim 1, wherein the panel is curved.

20. A glazing assembly, comprising:

a first pane of glass;

a second pane of glass, the first pane of glass spaced apart from and in opposing relation to the second pane of glass; and a curtain assembly disposed between the first and second panes of glass and substantially parallel to the first pane of glass, the curtain assembly comprising:

a panel of flexible fabric;

a first anchor assembly supporting a first end of the panel;

a second anchor assembly supporting a second end of the panel, the first and second ends being opposite each other along a first axis;

the panel comprising a plurality of spaced apart slits through the panel, each slit having a component transverse to the first axis, the slits arranged in an array, the array comprising a first plurality of the slits forming a first row, and a second plurality of slits forming a second row, each of the first and second rows extending a transverse direction to the first axis, and the slits of the first row being laterally offset from and overlapping with corresponding slits of the second row in the transverse direction, wherein one of the slits of the first row overlaps a corresponding one of the slits of the second row by an overlap distance greater than zero, wherein each slit also has a component along the first axis that causes the slit to define a flap that protrudes outside a plane of the panel when the panel is stretched; and an actuator associated with the first anchor assembly, the actuator arranged to move the first anchor relative to the second anchor in a manner sufficient to stretch and relax the panel along the first axis.

21. The glazing assembly of claim 20, further comprising a frame connecting the first and second panes.

22. The glazing assembly of claim 21, wherein the frame extends around outer peripheral edges of the first and second panes.

23. A method of controlling transmission of light across a barrier with a curtain assembly, the curtain assembly comprising a panel of flexible fabric, a first anchor assembly supporting a first end of the panel, a second anchor assembly supporting a second end of the panel, the first and second ends being opposite each other along a first axis, the panel comprising a plurality of spaced apart slits through the panel, each slit having a component transverse to the first axis, the slits arranged in an array, the array comprising a first plurality of the slits forming a first row, and a second plurality of slits forming a second row, each of the first and second rows extending a transverse direction to the first axis, and the slits of the first-row being laterally offset from and overlapping with corresponding slits of the second row in the transverse direction, wherein one of the slits of the first row overlaps a corresponding one of the slits of the second row by an overlap distance greater than zero, wherein each slit also has a component along the first axis that causes the slit to define a flap that protrudes outside a plane of the panel when the panel is stretched, and an actuator associated with the first anchor assembly, the actuator arranged to move the first anchor relative to the second anchor in a manner sufficient to stretch and relax the panel along the first axis, the method comprising the steps:

opening the curtain assembly by causing the slits to deform into larger openings by actuating the actuator to stretch the panel along the first axis; and closing the curtain assembly by allowing the openings to relax back to the slits by reversing the actuator to relax the panel along the first axis.

24. The method of claim 23, wherein the anchor assembly comprises a roller, and wherein the step of opening comprises the actuator causing the roller to wind in a first direction, and the step of closing comprises allowing the roller to unwind in a second direction opposite the first direction.

25. The method of claim 23, wherein the actuator is adapted to move the first anchor assembly in translation toward and away from the second anchor assembly, and wherein the step of opening comprises moving the first anchor assembly from a first position in translation away from the second anchor assembly to a second position, and the step of closing comprises moving the first anchor assembly from the second position back toward the first position.

* * * * *